US005476225A

United States Patent [19]

Chan

[11] Patent Number: 5,476,225

[45] Date of Patent: Dec. 19, 1995

[54] MULTI SPRAY PATTERN SHOWER HEAD

[75] Inventor: Raymond W. M. Chan, Vancouver, Canada

[73] Assignee: Jing Mei Industrial Limited, Tsuen Wan, Hong Kong

[21] Appl. No.: 265,426

[22] Filed: Jun. 24, 1994

[51] Int. Cl.[6] ..... B05B 1/16; B05B 1/08

[52] U.S. Cl. ..... 239/449; 239/383

[58] Field of Search ..... 239/443, 446–449, 239/381, 383

[56] References Cited

U.S. PATENT DOCUMENTS

| | | | |
|---|---|---|---|
| 4,187,986 | 2/1980 | Petrovic | 239/449 |
| 4,467,964 | 8/1984 | Kaeser | 239/449 |
| 4,754,928 | 7/1988 | Rogers et al. | 239/447 |
| 5,316,216 | 5/1994 | Cammack et al. | 239/447 |

OTHER PUBLICATIONS

Shower Massage™ brochure, SM80 Series model, Teledyne Water Pik, Fort Collins, Colorado © 1993.

*Primary Examiner*—Karen B. Merritt
*Attorney, Agent, or Firm*—Laff, Whitesel, Conte & Saret, Ltd.

[57] ABSTRACT

A shower head has a plurality of concentric circular water races, each race having therein a different pattern of spray emitting openings. An elastomeric sheet is spread between a water plenum and the races to prevent water from leaking from the plenum and into the races. The elastomeric sheet has an opening over each race. A selector may be either a dial or a push button which moves a device that covers or uncovers openings in the elastomeric sheet in order to select a specific spray pattern. The push button or a rubber boot over the dial facilitates an operation of the selector when the user has soapy hands.

13 Claims, 9 Drawing Sheets

MULTI SPRAY PATTERN SHOWER HEAD

This invention relates to shower heads and more particularly to simplified shower heads having a plurality of spray patterns.

There are many shower heads which can deliver sprays in any of a plurality of different patterns ranging from a gentle spray through a pulsing spray to a gushing flow. In general, there are two approaches to providing means for selecting between these spray patterns. One approach is to provide a face plate with a plurality of alternative spray heads formed therein which are sequentially placed in front of a water delivery passageway as the face plate is rotated. An example of such a shower head is found in U.S. Pat. No. 3,998,390.

Another approach is to form a face plate with all spray orifices located in concentrical circular patterns. An internal device may be operated to direct the incoming water to any of the circular patterns. An example of such a shower head is found in U.S. Pat. No. 3,801,019.

Each of these and other such shower heads presents a number of problems and other considerations such as cost, liming, flexibility of design, ease of changing features on the shower head especially with soapy hands, simplicity of manufacture and assembly, and the like.

A few of the other U.S. patents relating to this type of shower head are:

| | | | |
|---|---|---|---|
| 4,068,801 | 4,303,201 | 4,588,130 | 5,199,639 |
| 4,165,837 | 4,346,844 | 4,629,121 | 5,201,468 |
| 4,187,986 | 4,397,050 | 4,903,987 | 5,215,258 |
| 4,190,207 | 4,398,669 | 5,082,183 | |

Accordingly, an object of the invention is to provide new and improved means for and methods of giving selectable shower patterns to shower heads. Here, an object is to reduce costs by simplifying the design of a shower head by minimizing the number of required parts and manufacturing costs. In this connection, an object is to provide alternative models of shower heads at the least possible cost, and with the least possible changes in piece parts, manufacturing, and assembly.

Yet another object of the invention is to provide "good, better, and best" options, which are popular with modern marketing.

Still another object is to provide a shower head with a design which is less likely to collect lime.

A further object is to provide a shower head wherein a person with soapy hands can change shower spray patterns with greater ease.

In keeping with one aspect of this invention, these and other objects are accomplished by a simple housing having a face plate with plurality of concentric races along with a distributor plate having a number of channels which can direct water into any one of the races. Each race has a pattern of orifices through which water may be emitted to provide a predetermined spray pattern. One of the races contains a turbine that causes the water emitted from that race to pulse.

The various models of shower heads may be produced by simply replacing a single piece part with a selected number of holes therein. For example, if that piece part has five holes, water may be introduced into any selected one of five different races to give any one of five different spray patterns. If the piece part has three holes in it, the water may be introduced into only three of the races, thus giving three different spray patterns. The shower head described herein is controlled by a rotary dial which may be turned to any of five positions in the first example or three positions in the second example.

Other embodiments provide means for changing water spray patterns with greater ease when the user has soapy hands. A first embodiment for soapy hands use has a low cost minimum feature shower head which switches between two spray patterns in response to the push of a button. A second embodiment of these soapy hands shower heads has a spray selector dial covered with an elastomer boot.

Preferred embodiments of the invention are shown in the attached drawings, in which.

Figure 3:
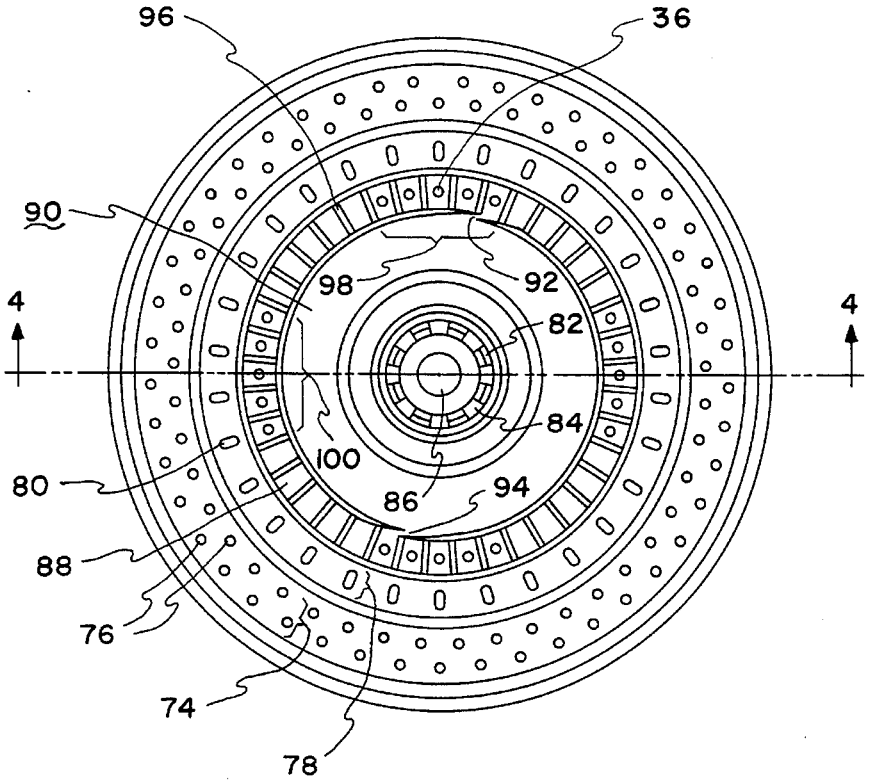
Figure 2:
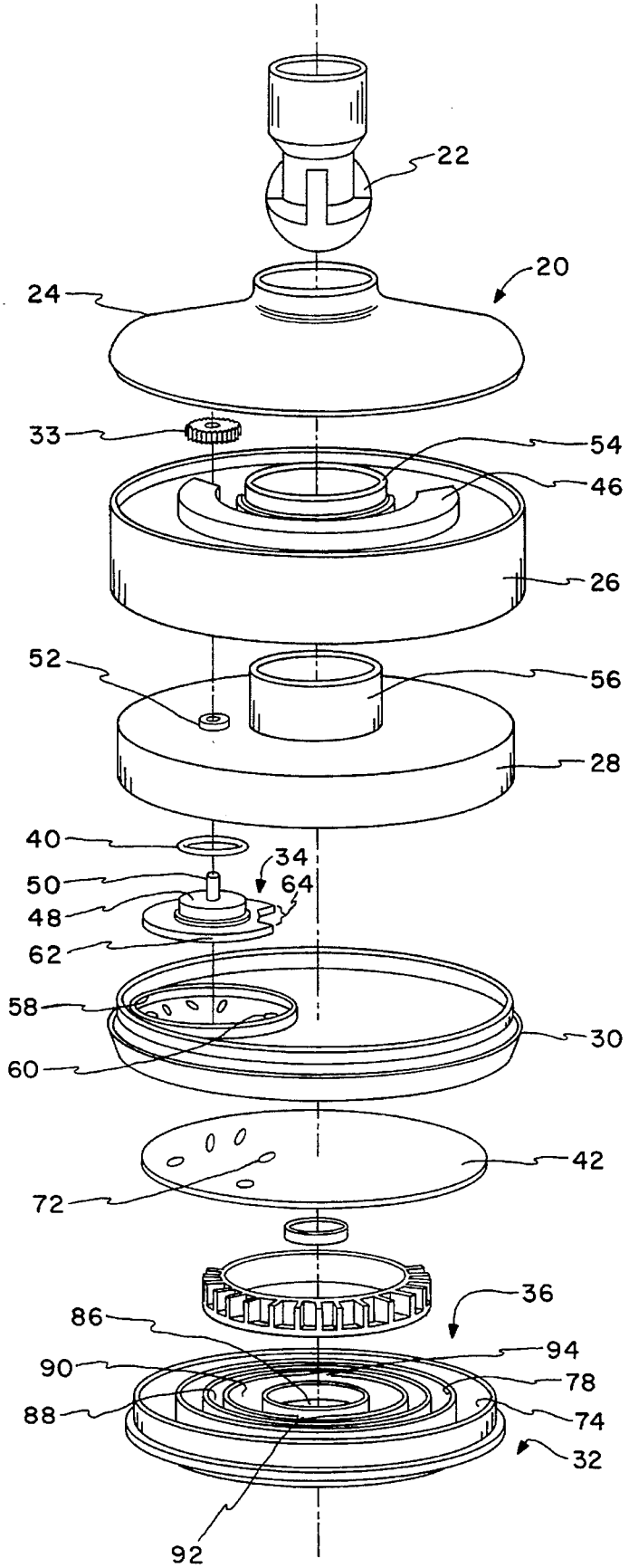
FIG. 2 is an exploded view of the inventive shower head shown in FIG. 1.
Figure 2A:
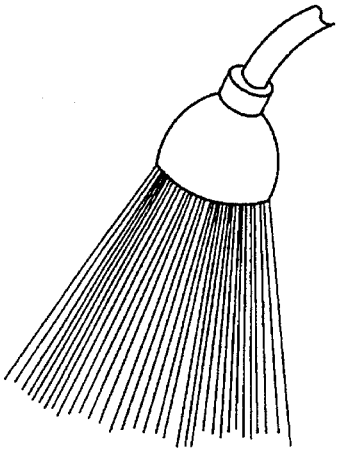
Figure 2D:
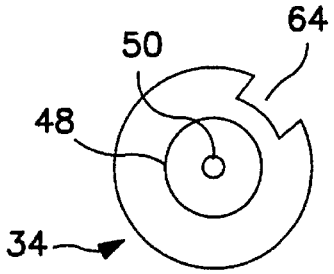
Figure 2B:
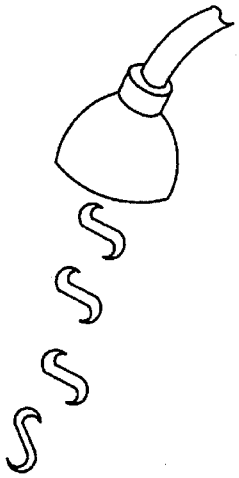
Figure 2E:
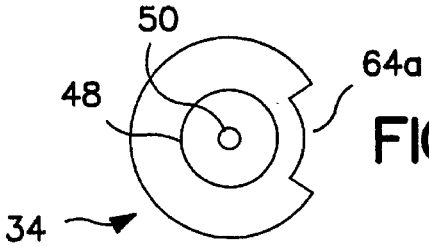
Figure 2C:
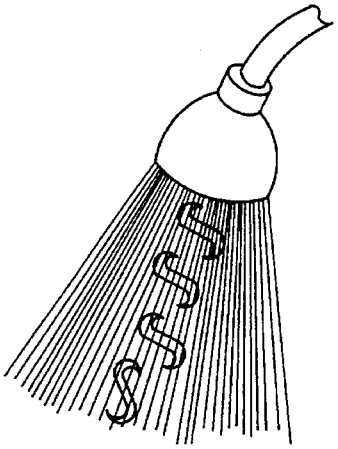
Figure 4:
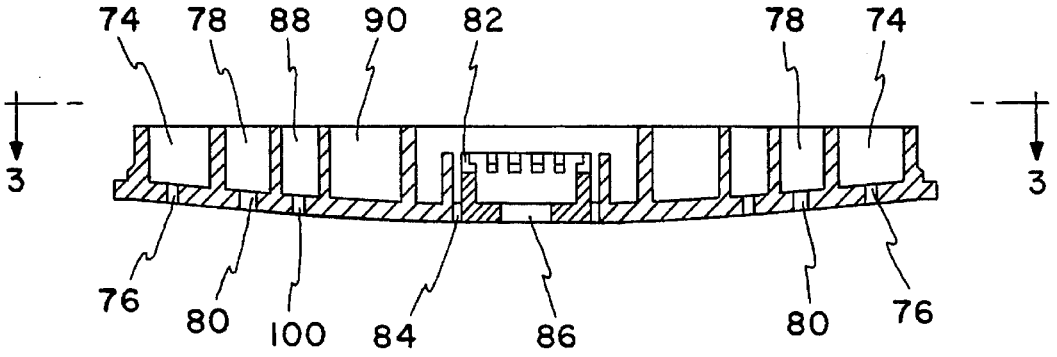
Figure 5A:
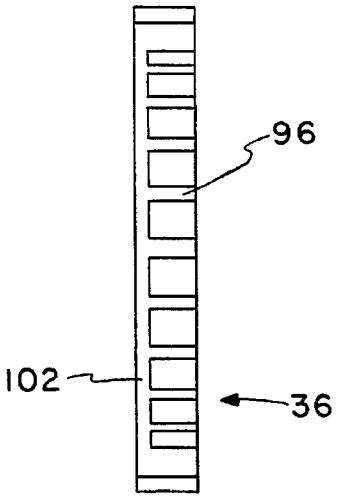
Figure 5B:
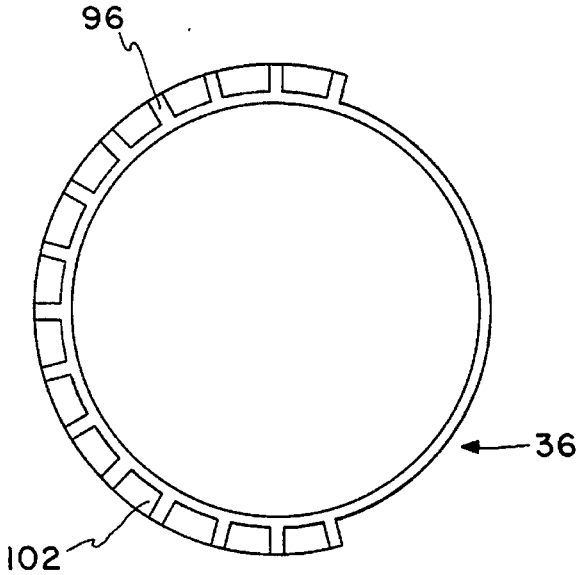
Figure 6:
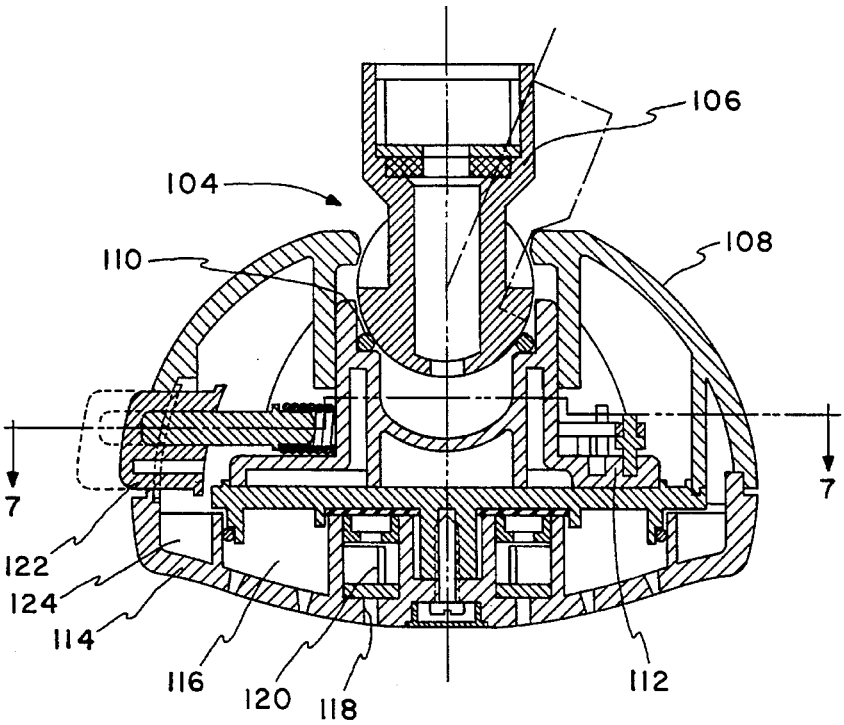
Figure 7:
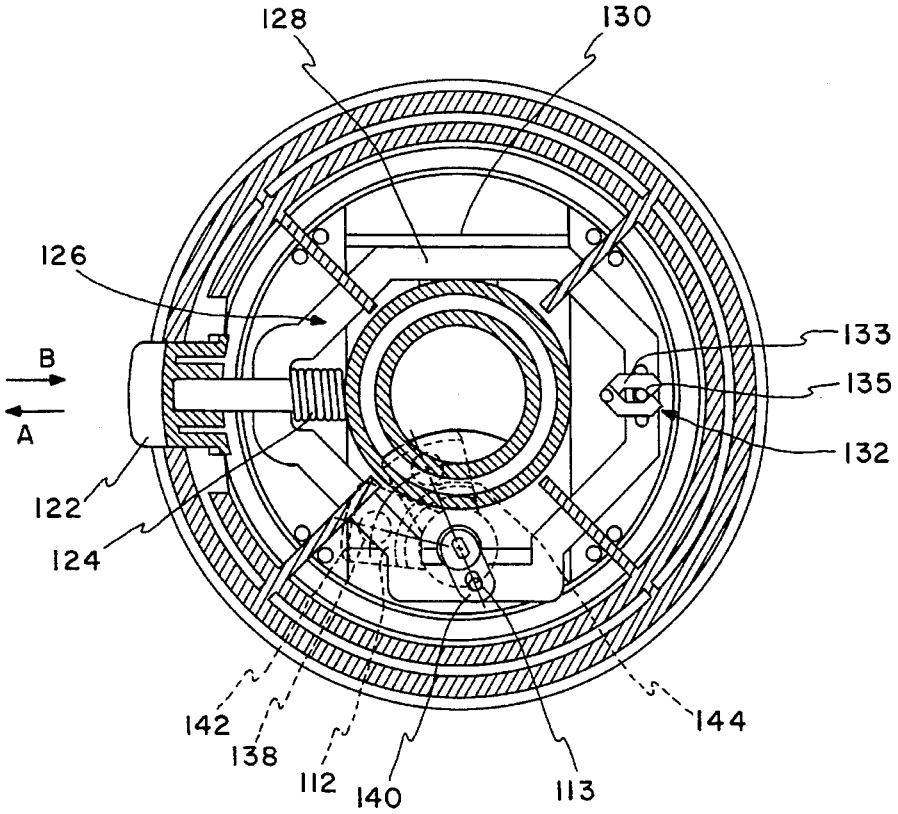
Figure 8:
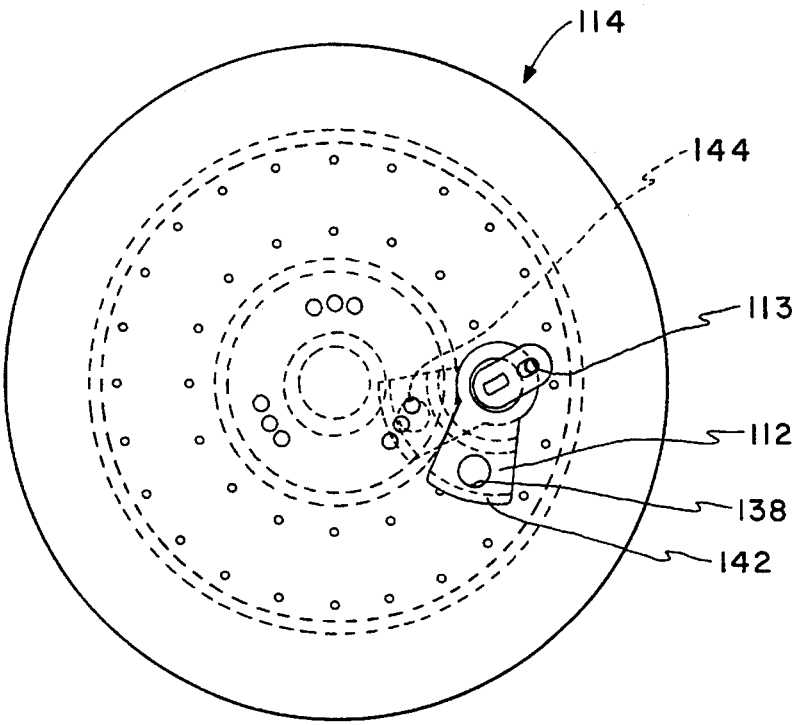
Figure 9:
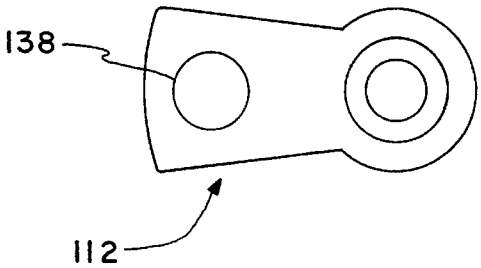
Figure 10:
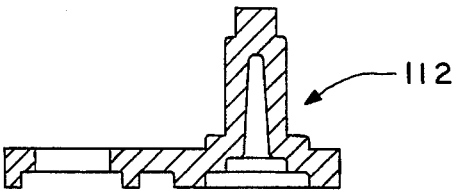
Figure 11:
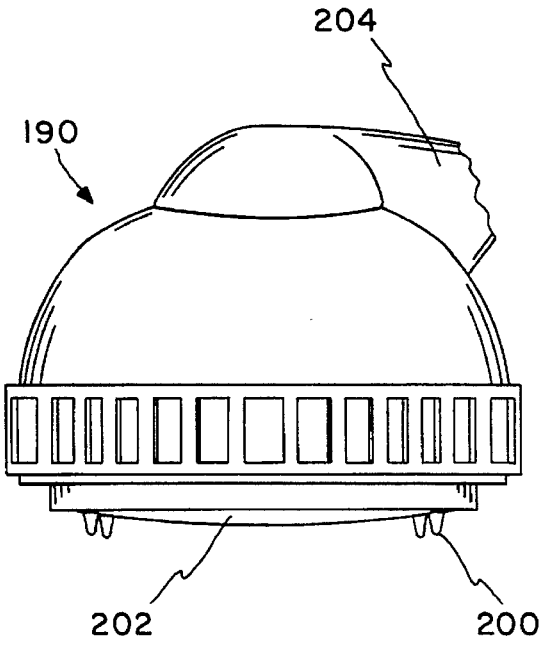
Figure 12:
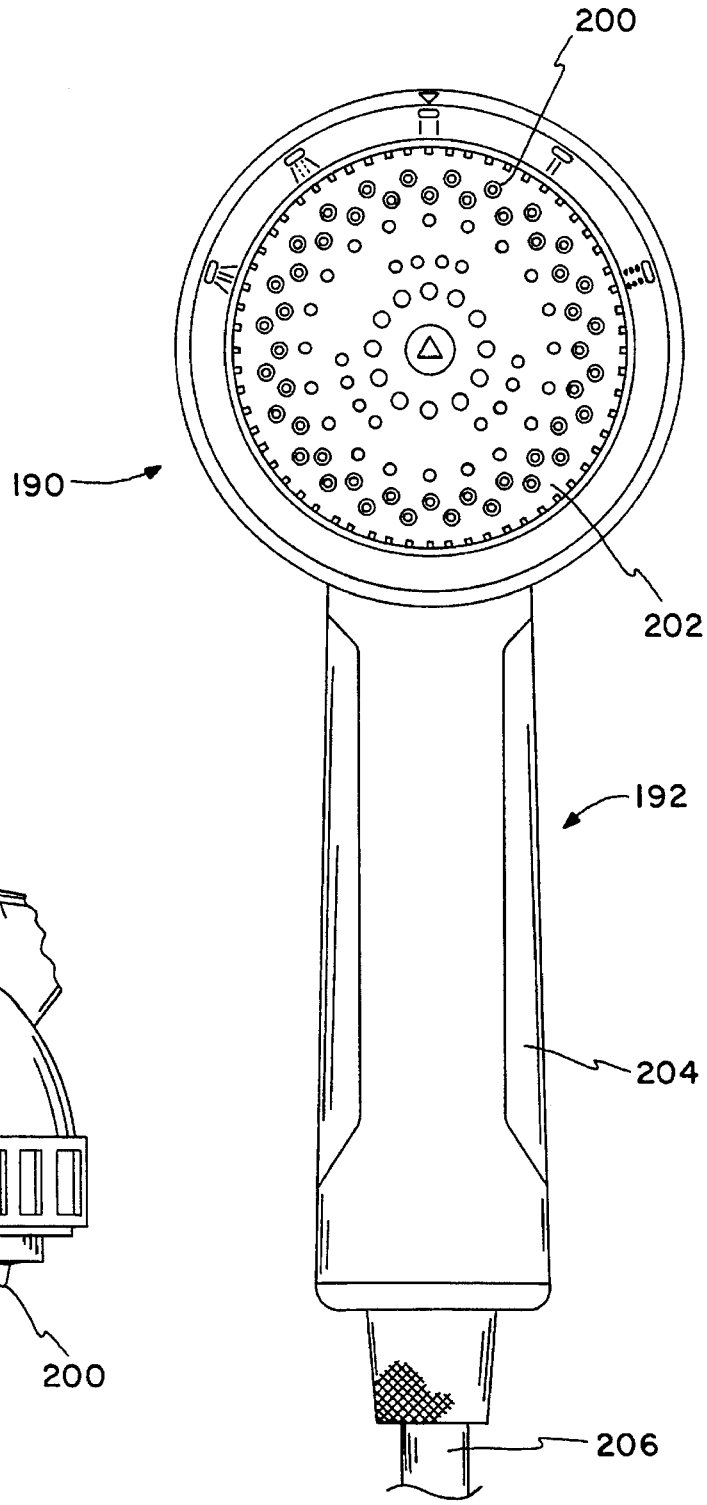

FIG. 2*a* shows a first and fine spray pattern;

FIG. 2*b* shows a second and pulsating spray pattern;

FIG. 2*c* shows a combination of a fine spray and a pulsating spray pattern by way of example;

FIG. 2*d* shows a distributor flange with a profile for giving a single spray pattern;

FIG. 2*e* shows a distributor flange for simultaneously giving different spray patterns;

FIG. 3 is a plan view of a face plate of a shower head giving one example of orifices for different spray patterns;

FIG. 4 is a cross section taken along line 4—4 of FIG. 3;

FIGS. 5A, 5B are elevation and plan views of a turbine which gives a pulsating spray;

FIG. 6 is a cross section of a second and soapy hands embodiment featuring a two pattern shower head taken along line 6—6 of FIG. 7;

FIG. 7 is a cross section taken along line 7—7 of FIG. 6;

FIG. 8 is a plan view of a face plate of the shower head of FIGS. 6, 7;

FIG. 9 is a plan view of a distributor for the shower head of FIGS. 6–8;

FIG. 10 is a cross section taken along line 10—10 of FIG. 9;

FIG. 11 is a side elevation which shows a hand-held shower head with a plurality of massaging units associated therewith;

FIG. 12 is a bottom plan view of a hand held shower head which may incorporate the invention.

Figure 13:
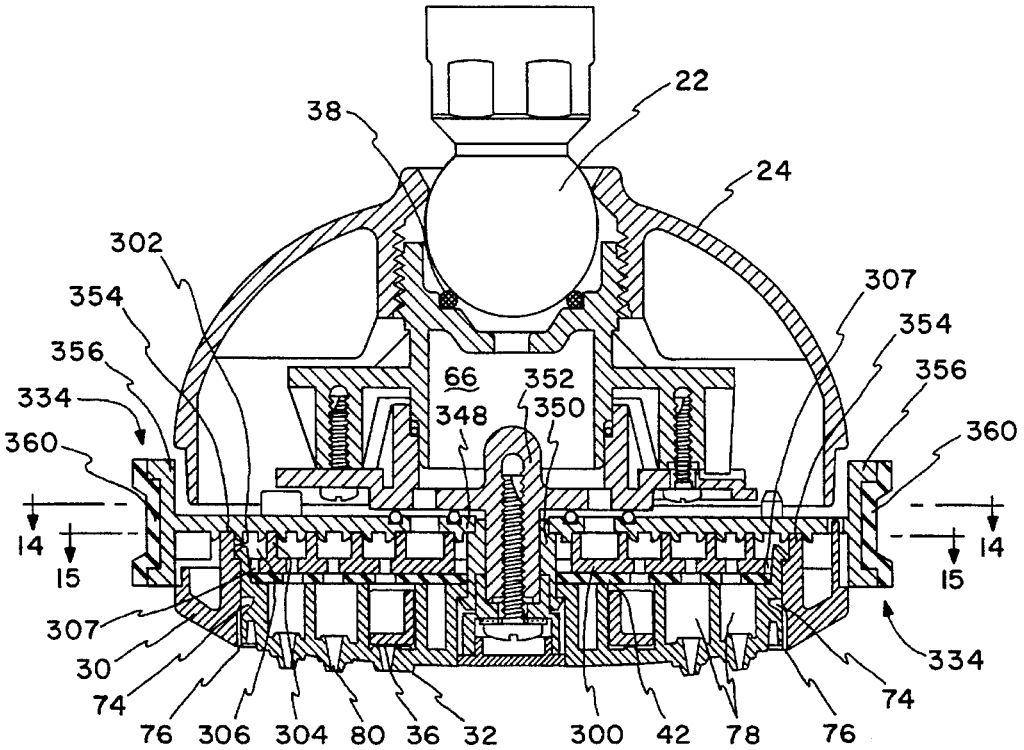
Figure 14:
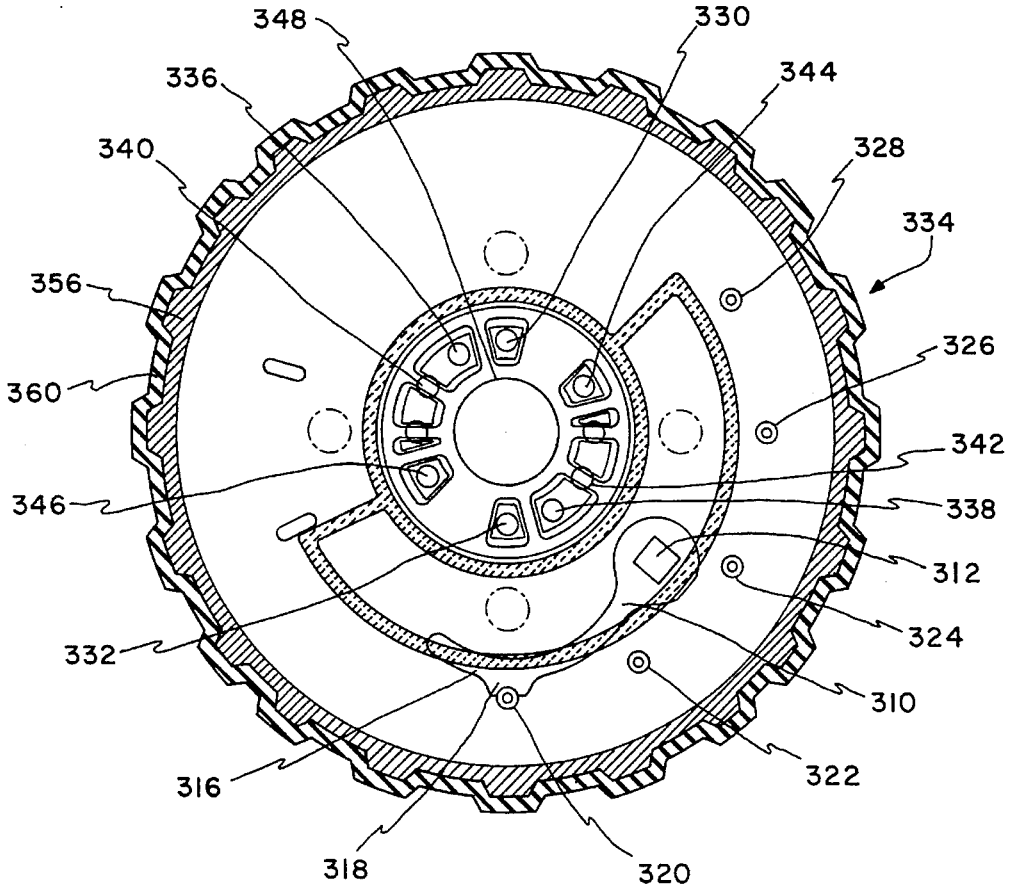
Figure 15:
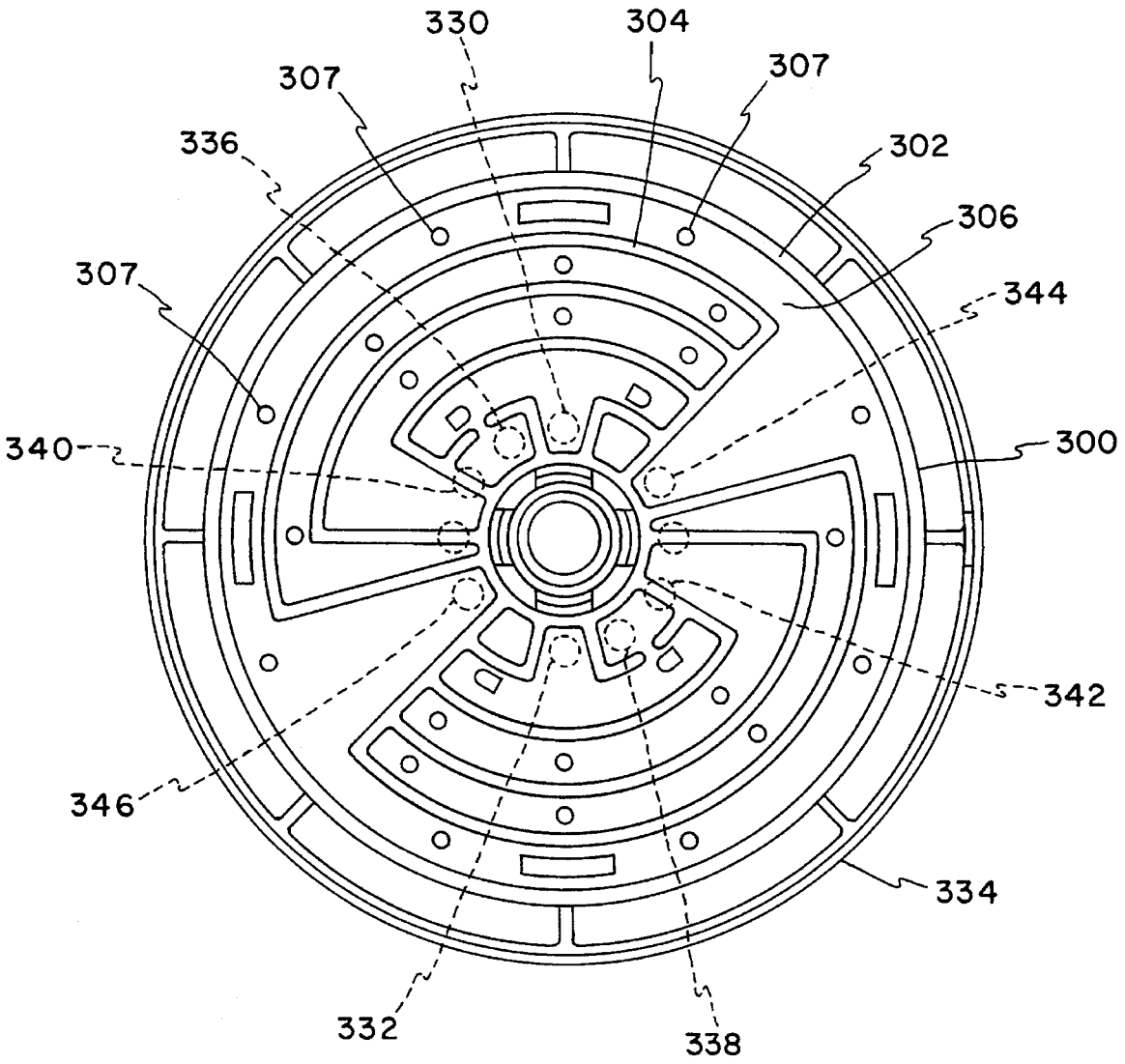

FIG. 13 is a cross-section of a third and soapy hands embodiment;

FIG. 14 is a cross-section taken along line 14—14 of FIG. 13 and showing a selection looking detent; and FIG. 15 is a cross-section showing water distribution channels and taken along line 15—15 of FIG. 13.

Figure 1:
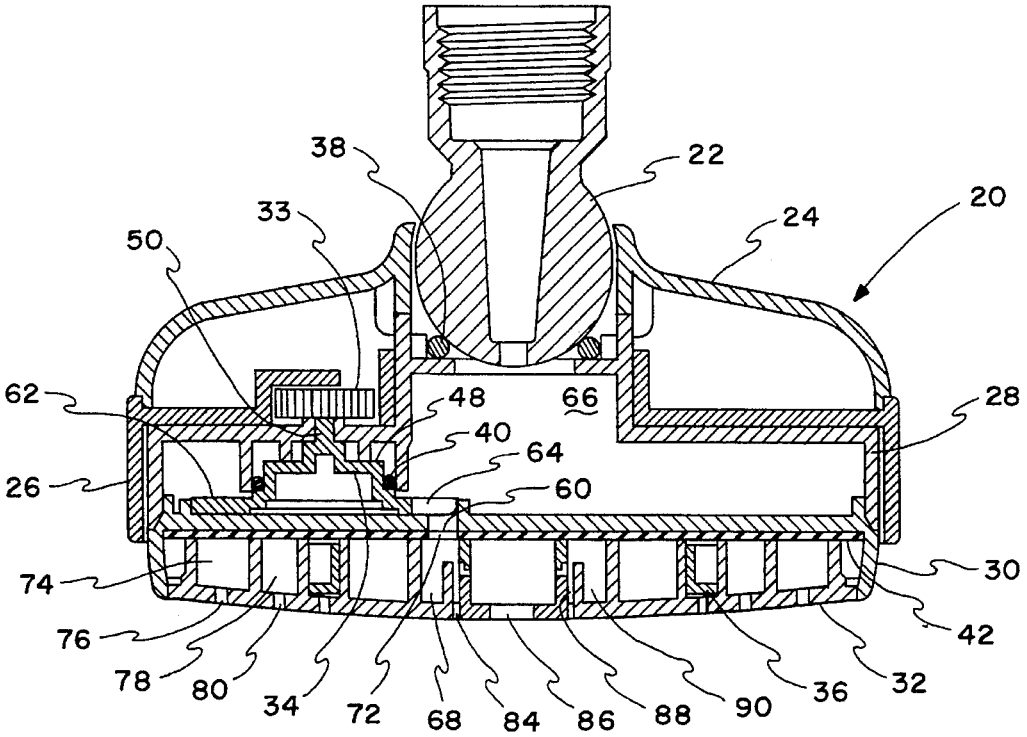
FIG. 1 is a cross section of a first embodiment of a multi-pattern shower head which is adapted to be placed on the end of a plumbing pipe.

FIG. 1 shows an exemplary shower head 20 which incorporates the invention. The principal parts of the shower head are a ball and socket swivel joint 22, an upper housing 24 which forms a water plenum, a selector dial 26, an inside housing 28, a lower cabinet part 30, and a face plate 32. A pinion gear 33 rotates in response to a turning of dial 26 in order to rotate a distributor plate 34. A rotor or turbine 36 is turned by the water passing through the shower head in order to produce a pulsing spray. Rubber O-rings 38, 40 provide water tight joints at the swivel joint 22 and at the distributor plate 34.

The exploded view of FIG. 2 shows how the inventive shower head is assembled. The pinion gear 33 is installed adjacent to an arcuate rack 46 molded into the select dial 26. An O-ring 40 is fitted over a shoulder 48 on distributor 34. Then, stem 50 is passed through a bearing hole 52 in the inside housing 28. The hub 54 on selector dial 26 is fitted over an upstanding axle 56 on inside housing 28 with pinion gear 33 being mounted and fixed on stem 50 of the distributor 34. Therefore, if dial 26 is rotated, the arcuate rack 46 turns pinion gear 33, which in turn rotates distributor 34. The length of arcuate rack 46 limits the angular rotating of dial 26.

The lower cabinet part 30 has an internal disk 58 which may be either centered in place or integral with lower cabinet part 30. A number of alternative disks (such as 58) or lower cabinet parts 30 have a different number of holes in them. For example, a disk 58 with five holes (one of which is numbered 60) gives water access to five underlying water races; a disk with four holes gives access to four underlying races; or a disk with three holes gives access to three underlying races.

Means are provided for giving "good, better, and best" shower heads in response to a selection and use of one of alternative piece parts. More particularly, each race has a different pattern of spray orifices in it. Therefore, a selection of a disk 58 with three holes gives a "good" shower head with three spray patterns. A selection of a disk 58 with four holes gives a "better" shower head with four spray patterns. A selection of a disk 58 with five holes gives a "best" shower head with five spray patterns.

The distributor 34 has a lower flange 62 with a peripheral opening 64 (FIG. 2*d*) formed therein. The flange 62 covers all of the holes in disk 58 except for the one exposed through the opening 64. Thus, as shown by way of example, in FIG. 1, the flange opening 64 is poised over hole 60 in disk 58 so that water may pass from a plenum 66 (FIG. 1) to a race 68 and out a spray orifice 84. If dial 26 had been turned to rotate pinion gear 33, and therefore distributor 34, so that opening 64 uncovered some other hole in disk 58, water would be directed to some other race and a different spray pattern would result.

The next part in the shower head assembly (FIG. 2) is an elastomer disk 42 which seals the bottom of the lower cabinet 30 to the top of the face plate 32 thereby preventing water from leaking from the plenum into the races. There are holes in disk 42 (one of which is numbered 72) that are in alignment with the corresponding holes in disk 58. Hence, the elastomer disk 42 provides a seal which forces any water in plenum 66 (FIG. 1) to pass through the selected hole in disk 58 and prevents leakage elsewhere.

The face plate 32 is attached at its periphery to the lower cabinet part 30. The face plate 32 has a plurality of concentrically oriented, circular races molded therein. In the bottom of each race (FIG. 3) are a number of spray holes arranged in circular patterns to give a variety of shower patterns. Accordingly in the bottom of an outer race 74 (FIGS. 2, 3, 4) are a number of relatively small diameter holes 76 to give a relatively fine spray. In the bottom of the next interior race 78 are a number of relatively large diameter holes 80 to give a relatively coarse spray. In the center of the shower head is a race 82 which has a number of closely spaced, relatively large holes 84 and a center hole 86 which give a gushing effect that is similar to water running out of a faucet and which is especially attractive for shampooing.

A race 88, 90 provides a pulsing spray, the water originally entering race 90 and exiting race 88. More particularly, as best seen in FIG. 3, the race 88, 90 is separated by a wall having breaks therein with a tapered wall cross section which directs the water to enter race 88 at an angle which is tangential to a turbine 36, which is best seen in FIGS. 5A, 5B. The turbine 36 has a flange 102 with number of upstanding fins 96 which are impinged by the water entering the race 88 via wall breaks 92, 94. As a result, the turbine 36 spins in the race 88.

The spray holes in the bottom of the race 88 are grouped, as at 98, 100 (FIG. 3). The turbine flange 102 covers two or three groups of the holes 98, 100 depending upon its instantaneous position. Therefore as the turbine 36 spins, the water issues from successive ones of the groups of holes 98, 100, as flange 102 uncovers them owing to its spin, thereby giving a massaging effect.

Accordingly, depending upon the position of the opening 64 of distributor 34 (FIG. 2), relative to the holes 60, 72 in disks 58 and 42, water may be introduced into any one of the races 74, 78, 82, 88 to give a selected one of the spray patterns. If someone wishes to provide a different combination of spray patterns, it is only necessary to change the profile of disk 32 and, perhaps opening 64 in distributor flange 62, such as shown by profile 64*a* (FIG. 2*e*). The shower head could be arranged to simultaneously give different spray patterns (FIG. 2*c*), such as the fine spray issuing from holes 76 (FIG. 2*a*, 3) and the pulsating spray (FIG. 2*b*) issuing from groups of holes 98, 100, the simultaneous spray pattern being shown in FIG. 2*c*.

After the components shown in FIG. 2 have been assembled, the subassembly of swivel joint 22, and upper housing 24 (FIGS. 1, 2) is peripherally cemented or otherwise bonded to the top of lower cabinet part 30 to complete the assembly of the shower head.

A second embodiment of the invention 104, shown in FIGS. 6–8, provides two spray patterns which may be selected by a push button operation. The major parts are a swivel joint 106, an outside housing 108, an inside housing 110, a distributor plate 112, and a face plate 114. These major parts are approximately the same as the corresponding parts shown in the first embodiment of FIGS. 1–5. This second embodiment has two races 116, 118 with a turbine 120 in race 118.

The shower pattern or race selection mechanism is best seen in FIG. 7.

A shower spray pattern selection push button 122 is biased in an outward direction by a coiled spring 124. The push button 122 acts upon an actuator ring 126 which has a straight edge 128 that rides against a flat abutment 130 which serves as a track to slide in reciprocal motions responsive to repeated push button operations. A latch mechanism 132 has two lever arms 133 which spread apart to capture a pin 135 when the push button is pushed once, and which releases it when the push button is pushed a second time. This latch mechanism both limits linear travel and helps stabilize the far side of the actuator ring 126.

The distributor plate 112 is pivotly mounted at 113 and has an opening 138 therein. The position of plate 112 is controlled by a link 140 which is connected to actuator 126. As the push button 122 moves the actuator ring 126 forward in a first direction (Direction A), link 140 causes distributor plate 112 to rotate about pivot point 113 so that opening 138 is at position 142 over one race. When the push button is pushed a second time, latch mechanism 132 releases the actuator ring 126 and coiled spring 124 pushes the button 122 to an extended position as actuator ring 126 moves back in a reciprocal direction (Direction B). This causes link 140 to turn the distributor plate 112 about pivot point 113 to a position where opening 138 is in position When opening 138 is in position 142 (FIGS. 8 and 9), a steady spray pattern of water occurs. When opening is in position 144, a pulsating spray pattern of water occurs.

FIGS. 11 and 12 show the inventive shower head 190 used on a hand held unit 192. Internally, the shower head 190 is the same as either of the two earlier described embodiments (FIGS. 1 or 6).

A plurality of finger-like elastomeric protuberances 200 surround at least the pattern of shower spray holes on the shower head. The invention further contemplates having such protuberances scattered across the face plate 202, among the shower spray holes. These protuberances can be used to physically massage the body, scalp, or the like.

The shower head 190 is mounted on one end of a handle 204 having a switchable elastomeric hose 206 connected to the other end. The opposite end of hose 206 is connected to any suitable source of water, such as a tub faucet or plumbing fitting. A passage (not shown) within the handle 204 may convey water from hose 206 to the shower head 190 and out the spray pattern holes.

Usually the flow of water to the shower head is controlled by a valve at the plumbing fitting. However, it is within the scope of the invention to provide a valve in the handle or shower head. For example, the valve could be controlled by an extra setting of the select dial 26 (FIG. 1) or push of button 122 (FIG. 6). Opening 64 (FIG. 1) on distributor 34 (FIG. 1) or opening 138 (FIG. 6) on distributor 112 (FIG. 6) may simply be moved to a position where water does not pass into any of the races.

A third embodiment (FIGS. 13–15) has a simplified low cost construction. The primary difference between FIGS. 1 and 13 is that FIG. 1 uses a gear 33 and FIG. 13 uses a ring 26 selector alone. Those parts which are the same as the parts in the earlier figures have the same reference numerals in FIGS. 13–15 and will not be described again.

A water distribution plate 300 (FIG. 15) has a plurality of upstanding walls, as at 302, 304, defining a water channel 306 between them. A plurality of holes 307 in the bottom of channel 306 deliver water to a race in face plate 32. A spray pattern is delivered via race 74 and spray holes 76 when channel 306 is energized with water.

In FIGS. 13 and 14, a detent spring 310 has one end 312 anchored to upper housing at 312. The opposite end 316 of detent spring 310 has a tooth 318 which snaps over any one of a plurality of detents 320–328. Here, it is assumed that, with the detent spring tooth 318 snapped over detent 320, water flows through water distribution plate 320 holes "1" at 330, 332 in FIG. 14. If the dial 334 is turned so that detent spring tooth 318 snaps over detent 322, water flows through water distribution plate 300 holes "2", at 336, 338. Likewise, with detent spring tooth 318 snapped over detent 324, water flows through water distribution plate 300 hole "3" at 340, 342. In a similar manner, any suitable number of water distribution plate holes may be provided and selected by turning dial 334.

On each hole selection, water flows into a channel formed in water distribution plate 300 (FIG. 15). For example, when the detent spring tooth 318 (FIG. 14) is snapped over the last detent 328, water flows through water distribution plate 300 hole "5" at 344,346. The water fills peripheral channel 306. Thus, a spray of water flows out of holes in the water distribution plate, into a race in the face plate, and out water spray holes therein. For example, water emerging from holes 76 provide a fine spray of water in a circular spray pattern.

The dial 334 has a central hole 348 which is mounted to turn about a central axle 350 provided by a sleeve that slips over a post 352 on upper housing 24. The outer edge of dial 334 is supported by a circumferential bearing surface at 354, 354. Between center and outer supports 352, 354, the water distribution plate 334 rides on the upper edges of the channel walls, such as 302, 304.

The detents 320–328 (FIG. 14) and tooth 318 arrangement provides for turning the dial 334 in either a clockwise or a counterclockwise direction with equal ease.

The dial 324 has a circumferential wall with a substantial vertical dimension 356 which gives a good gripping surface for a user who wants to turn the dial. A rubber, or other suitable elastomer, boot 360 fits over the circumferential vertical wall to provide a more positive gripping surface for a person with soapy hands.

Those who are skilled in the art will readily perceive how to modify the invention. Therefore, the appended claims are to be construed to cover all equivalent structures which fall within the true scope and spirit of the invention.

The invention claimed is:

1. A shower head housing with a coupler for connecting the shower head to a source of water, said shower head comprising:

a plenum connected to receive water from said source of water, a face plate closing said plenum, said face plate having a plurality of concentric races therein and on one side thereof which faces into said plenum, each of said races having a pattern of orifices formed therein through which water may pass to an opposite side of said face plate in order to provide a predetermined spray pattern which is individually unique to each of said races, a turbine rotor in one of said races, water in said one race impinging said turbine rotor to drive it in a spinning motion, said turbine rotor successively covering and uncovering orifices in said one race depending on the turbine rotor's instantaneous position as said turbine rotor spins, whereby said turbine causes the water emitted from said one race to pulse, a distributor having at least an opening to enable a selective directing of water into any of the races and to block water from reaching other of said races, an elastomeric sheet captured between the distributor and the face plate for blocking water from leaking from said plenum through said face plate, the elastomeric sheet having perforations aligned with said races to allow water to pass from said plenum through said sheet and into at least a selected one of said races as directed by said distributor, and a selector for aligning the distributor with at least one of said races in order to direct water from said plenum into at least one of said races.

2. The shower head as defined in claim 1 in which the race containing the turbine rotor includes a circular wall having at least one break therein, said wall near said break being tapered toward the break, and said break directing the impinging water tangentially toward the turbine rotor, the orifices in the race containing said turbine rotor being grouped into a plurality of spaced apart groups, and said turbine having an arcuate flange on the bottom thereof to cover and uncover said groups of orifices as said rotor spins.

3. The shower head as defined in claim 1 in which said races have a plurality of individually associated patterns of orifices to provide the following predetermined spray patterns:

large diameter orifices which produce a gushing pattern of emitted water, small diameter orifices which produce a fine spray pattern, intermediate diameter orifices which produce a coarse spray pattern, and groups of orifices which produce a pulsing pattern in combination with the turbine rotor.

4. The shower head as defined in claim 3 in which said distributor may select more than one of said races to produce a combination of said spray patterns.

5. The shower head as defined in claim 1 in which the shower head is a hand-held device coupled to a source of water via an elastomeric hose, and said face plate includes rubber protuberances for massaging the body during a shower.

6. The shower head as defined in claim 1 in which said selector comprises a replaceable part which may be selected in order to provide different models of shower heads having different features.

7. The shower head as defined in claim 1 in which the selector is:

a push button controlled mechanism, and said distributor comprises a pivoted plate with an opening in it, and said push button mechanism swinging said pivoted plate to position said opening over a selected race to enable a direction of the water among the races.

8. The shower head as defined in claim 1 in which the selector is:

a dial mechanism, and said distributor comprises a post having a rotatable flange mounted thereon, an opening in said flange, said dial mechanism comprising an arcuate rack and pinion gear for enabling and controlling a rotation of said flange to place its opening in a selected position for directing water from said plenum into said selected race, and said rack limiting the rotation of said dial mechanism to a particular arc.

9. The shower head of claim 1 wherein said selector is a dial having an elastomeric outer surface for enabling a use by a person with soapy hands.

10. The shower head of claim 9 wherein said dial is held in place by a spring-detent mechanism which enables bi-directional dial movement.

11. A shower head having a plenum and a face plate separated by a water seal, at least two concentric circular races having openings therein, a water distribution system interposed between said races and said plenum for selectively directing water from said plenum through a selected opening in said seal to a race individually associated with said selected opening, said distribution system including a mechanism for guiding and directing a water flow, control means for directing water to said selected opening, and means outside said shower head for selectively operating said water distribution mechanism for causing said water to reach the opening and its selected race, said mechanism comprising a center post mounted to rotate, said post having a pinion gear affixed to one end and a flange affixed to the other end whereby a turning of said pinion gear rotates said flange, said comprising an elastomeric sheet with openings over individually associated ones of said races, and said flange having at least one opening for uncovering at least one while covering other openings in said elastomeric sheet, thereby selecting the race individually associated with the uncovered opening, and a manually operated dial having an arcuate rack for turning said pinion gear.

12. The shower head of claim 11 and means associated with said arcuate rack for limiting the turning of said pinion gear.

13. The shower head of claim 11 wherein said mechanism comprises an actuator ring which slides in reciprocal directions responsive to repeated push button operations, latch means associated with said actuator ring for selectively holding said actuator ring in either of at least two positions responsive to repeated operations of said push button, a pivotly mounted plate coupled to swing between at least two positions responsive to reciprocal motion of said actuator ring, and an opening in said plate for covering and uncovering said openings in said seal for causing said water to reach said selected race.

* * * * *